United States Patent [19]

Biddle et al.

[11] 4,407,119

[45] Oct. 4, 1983

[54] GAS GENERATOR METHOD FOR PRODUCING COOL EFFLUENT GASES WITH REDUCED HYDROGEN CYANIDE CONTENT

[75] Inventors: Richard A. Biddle; Calvin W. Vriesen, both of Newark, Del.; Ernest S. Sutton, Landenberg, Pa.

[73] Assignee: Thiokol Corporation, Va.

[21] Appl. No.: 243,020

[22] Filed: Mar. 12, 1981

Related U.S. Application Data

[62] Division of Ser. No. 35,956, May 4, 1979, Pat. No. 4,298,412.

[51] Int. Cl.[3] ..... C06D 5/06

[52] U.S. Cl. ..... 60/219; 60/205; 149/19.1

[58] Field of Search ..... 149/19.1, 19.5; 60/205, 60/219

[56] References Cited

U.S. PATENT DOCUMENTS

| | | | |
|---|---|---|---|
| 3,193,421 | 7/1965 | Sutton | 149/19.5 |
| 3,362,859 | 1/1968 | Sutton et al. | 149/19.5 |
| 3,647,393 | 3/1972 | Leising | 149/72 |
| 3,692,495 | 9/1972 | Schneiter et al. | 149/19.5 |
| 3,797,854 | 3/1974 | Poole et al. | 60/219 |
| 3,806,461 | 4/1974 | Hendrickson et al. | 149/19.5 |
| 3,960,946 | 6/1976 | Dewitt et al. | 149/19.5 |
| 3,964,256 | 6/1976 | Plantif et al. | 60/219 |

*Primary Examiner*—Edward A. Miller

*Attorney, Agent, or Firm*—Gerald K. White; Richard J. Sheridan; Royal E. Bright

[57] ABSTRACT

Incorporation of various flame coolants, particularly ferrous oxalate, cupric oxalate and submicron size $Fe_3O_4$ in N,N'-dihydroxyethane diamide containing gas generants results in cooler flame temperature and reduced HCN content. Use of downstream coolants further reduces evolved gas temperature and also further reduces HCN content. Devices incorporating these propellants are useful inflators for many devices such as helicopter flotation bags, cargo pallet soft-landing bags, aircraft escape slides, inflatable life rafts and similar items. They are particularly suitable when these items must be man-rated.

1 Claim, No Drawings

GAS GENERATOR METHOD FOR PRODUCING COOL EFFLUENT GASES WITH REDUCED HYDROGEN CYANIDE CONTENT

This application is a division of application Ser. No. 035,956, filed May 4, 1979 and now U.S. Pat. No. 4,298,412.

BACKGROUND OF THE INVENTION

This invention relates to compositions of matter classified in the art of chemistry as gas generants more particularly as gas generants designed to produce relatively cool gas containing minimal components having toxic effects on warm blooded animals and to processes for their preparation and use.

N,N'-dihydroxyethane diamide (dihydroxyglyoxime, DHG) based propellants are known. Their combustion takes place at relatively high temperature (about 980° C. or more) and the evolved gases contain significant quantities of HCN (in the 4.0 mole percent range with exact values, of course, depending on the particular formulation).

There is a growing need for gas generator systems capable of producing quantities of gas at final temperatures in the range of 50° to 150° C. These applications are in the fields of inflatable or rigid structures such as helicopter flotation bags, cargo pallet soft-landing bags, aircraft escape slides, inflatable life rafts and similar items. The low temperture of the gases is required because the inflatable structures are fabricated from materials, frequently synthetic polymeric films and fabrics, such as nylon fabric bonded to polyurethane film or neoprene coated rubber combined with rayon fabric, which are rendered unusable by exposure to higher temperatures. To avoid attack on the structural materials, the evolved gases must be chemically inert to them and, as at least some potential uses require that the gases be physiologically inert to men and other warm blooded animals, the evolved gases must have minimal amounts of toxic components. A number of alkali metal azide based gas generant compositions suitable for automobile air bags have been successfully designed in conjunction with proper inflator units which are highly satisfactory and are reportedly being commercially developed.

Azides themselves are toxic materials and require precautions to avoid exposure during fabrication of any device employing them and care to avoid exposure during later use or disposal of any such device. Accordingly, a non-azide based system having the aforementioned desired attributes for its evolved gases would be of interest to the art. The present invention provides propellant compositions which, taken together with downstream coolants, are able to provide the desired cool gas containing low levels of hydrogen cyanide.

SUMMARY OF THE INVENTION

The invention provides a gas generator composition which comprises a binder component, a polynitrate ester plasticizer component, N,N'-dihydroxyethane diamide and a flame coolant component comprising cupric oxalate, ferrous oxalate, $Fe_3O_4$ or mixtures thereof.

The tangible embodiments of this composition aspect of the invention possess the inherent applied use characteristics of generating, upon combustion, substantial quantities of gas at low flame temperature, said gas containing 0.6 or less mole % HCN and said gas when contacted with certain downstream coolants being capable of being further reduced in HCN content and temperature.

Preferred embodiments of this composition aspect of the invention are those wherein:

a. The binder component is based upon a poly(ester).

b. The polynitrate ester plasticizer component is trimethyolethane trinitrate.

c. The flame coolant component is a 1:1 mixture of ferrous oxalate dihydrate and $Fe_3O_4$.

The invention also provides a process for the generation of gas having a temperature of less than about 575° C. and less than about 0.7 mole % HCN which comprises:

a. compounding and curing a gas generant composition comprising a binder component, a polynitrate ester plasticizer component, N,N'-dihydroxyethane diamide, and a flame coolant selected from cupric oxalate, ferrous oxalate, $Fe_3O_4$, or mixtures thereof;

b. igniting the gas generant composition of step a to generate combustion gases; and c. causing the combustion gases generated in step b to pass through a coolant bed of sodium bicarbonate, ammonium tartrate or guanidine carbonate, said coolant bed containing from about 1.2 to about 3.0 times the theoretical amount of coolant required to be chemically decomposed to cool said gases.

The invention further provides an improved gas generator composition based on N,N'-dihydroxyethane diamide wherein the improvement comprises replacing up to about 5% by weight of the total gas generator composition of said N,N'-dihydroxyethane diamide with $Fe_3O_4$, ferrous oxalate, cupric oxalate, or mixtures thereof.

DESCRIPTION OF THE PREFERRED EMBODIMENT

The manner of making and using the compositions of the invention will now be described with reference to particular embodiments thereof so as to enable one of skill in the art to practice same.

The gas generator compositions may be prepared by methods well known in the art. For example, the binder, plasticizer and flame coolant may be blended in a mixer in the order listed after which the N,N'-dihydroxyethane diamide may be added in increments with mixing continued until uniformity is achieved. Other compounding ingredients may, if desired, be incorporated at any convenient time during the mixing stage. Any required curing or crosslinking agents may be added just prior to casting or extruding into the desired shape. If desired, the last part of the mixing operation and the casting or extrusion operation may be performed under vacuum to avoid air entrapment resulting in voids in the finished gas generator composition. For example, a poly(oxydiethylene adipate) with carboxyl terminal functions, having a molecular weight of about 2200, 1:1 by weight mixture of chromium octoate and 2-ethyl hexanoic acid, a small amount of carbon black, trimethylol ethane trinitrate, N,N'-dihydroxyethane diamide and a 1:1 by weight mixture of $Fe_3O_4$ and ferrous oxalate dihydrate may be blended. A curing amount of the triglycidyl ether of p-aminophenol, conveniently 1.0 to 2.0% by weight, may be added and the mixture so formed may be poured into molds of suitable shape or extruded as rods or flat strips for cutting into pellets after cure. Conveniently, blending may be accomplished at about 55° C. to about 75° C., preferably at about 60° C. to about 65° C. and cure may be accomplished at about 49° C. to about 77° C., preferably at about 57° C. to about 66° C. The temperature range is, of course, not especially critical and one skilled in the art would readily be able to select a temperature range giving suitable viscosity for mixing and molding or extruding a particular generant composition as well as for accomplishing any required cure at any convenient rate.

One skilled in the art will recognize that in addition to the commercially available poly(oxydiethylene adipate) based binder illustrated other binders principally containing carbon hydrogen and optionally oxygen may be employed. Illustrative of these are, carboxy or epoxy terminated polybutadiene, copolymers such as polybutadiene acrylic acid, asphalt and pitches including natural asphalt having a 170° F. softening point, air blown asphalt having a 270° F. softening point, mixtures of asphalt and synthetic or natural rubber, pitch having a 240° F. softening point, mixtures of pitch and rubber, epoxy resins such as Araldite 502 and Epon 834, other liquid polymers such as polybutene and polyisobutylene, polyethylene, rubbers both natural and synthetic such as butyl rubber, waxes both natural and synthetic, having a melting point within the range of 150° F. to 300° F., and synthetic resins and plastics such as the various acrylic and polyvinyl resins.

Where required, conventional curing agents are selected and employed to effect cure of the binder. For example, polyisocyanates may be employed to cure hydroxy and epoxy terminated resins, and diaziridines, triaziridines, diepoxides, triepoxides and combinations thereof readily effect cures of carboxyl terminated resins. Unsaturated binders may be cured by free radical mechanisms frequently conveniently initiated by peroxides. Normally an amount of curing agent up to about 2% by weight of all the combined ingredients is sufficient for curing. The selection of the exact amount of curing agent for a particular gas generant composition will be well within the skill of one experienced in the art and will depend upon the particular resin, the curing time, the curing temperature and the final finished physical properties desired for the gas generant.

The binder component may include various compounding ingredients. Thus, it will be understood herein and in the appended claims that, unless otherwise specified, or required by the general context, the term "binder" is employed generically and encompasses binders containing various compounding ingredients. Among the ingredients which may be added are, for example, carbon black to add opacity and help control heat transfer, cure catalysts such as chromium octoate and diluents or suspending agents for the various "active" compounding ingredients. The binder content of the gas generant compositions will usually range from about 8½% to about 24% by weight.

In addition to the trimethylol ethane trinitrate plasticizer illustrated, one may employ any of the known liquid low molecular weight trinitrate esters commonly employed as plasticizers in pyrotechnic compositions. Illustrative of these are nitroglycerin, trimethylol methane trinitrate, trimethylol propane trinitrate, diethylene glycol dinitrate, triethylene glycol dinitrate, 1,2,4-butane triol trinitrate, bis(dinitropropyl)acetal, bis(dinitropropyl)formal, glycerol monolacetate trinitrate, glycol dinitrate and nitroisobutylglycerol trinitrate. The plasticizer may be employed at from about 10 parts by weight to about 30 parts by weight, preferably about 10 parts by weight to about 15 parts by weight of the total gas generant compositions.

N,N'-dihydroxyethane diamide may be employed at from about 10 parts by weight to about 80 parts by weight, preferably from about 60 parts by weight to about 75 parts by weight of the total gas generant compositions.

In addition to the 1:1 by weight mixture of ferrous oxalate dihydrate and $Fe_3O_4$, one may use cupric oxalate, ferrous oxalate or its hydrates, and $Fe_3O_4$, submicron sizes of $Fe_3O_4$ being preferred, as well as mixtures thereof in all proportions. The flame coolant may be employed at about 2 parts by weight to about 8 parts by weight, preferably from about 4 parts by weight to about 6 parts by weight of the total gas generant composition.

In the processes for the use of the gas generant compositions of the invention their use in conventional gas generator devices well known in the art is contemplated. Typically, such a gas generator will be of heavy walled construction preferably with a symmetrically arranged exhaust port array and will contain one or more devices, commonly screens or other filter material to prevent escape of particulate matter which may be hot corrosive, or toxic resulting in damage to the inflatable device to which the generator may be coupled by standard means or to the user of the inflated device in the event its integrity is breached. The gas generator will typically include a standard ignition device. A resistance wire is a convenient ignition device.

To assist in further cooling the gas exiting the gas generator and further reducing the hydrocyanic acid content of said gas certain coolant compositions have been found suitable. These are sodium bicarbonate, ammonium tartrate and guanidine carbonate. These will normally be employed in pelletized form as a bed in the exit gas stream. The use of standard binders such as stearic acid and carbowax is contemplated in forming the pellets of the coolants. Typically these coolants may be employed in quantities ranging from about 80% to about 98%, preferably from about 95% to about 98% relative to the weight of gas generant employed, that is from about 1.2 to about 3.0 times the amount theoretically required to cool the combustion gases by chemical decompositions.

The gas generants may be employed in the form of pellets or granules, or they may be cast into any particular monolithic shape for use in any particular application at the option of the skilled user.

The following examples further illustrate the best mode contemplated by the inventors for the practice of their invention.

In the following examples, closed bomb tests of gas generants of this invention are performed by burning in a constant volume chamber capable of withstanding gas pressures of up to 1000 pounds per square inch (psig). The chamber is fabricated of stainless steel and is connected to a pressure transducer, to detect the dynamic pressure generated by the sample, and to gas sample containers, which may be opened to collect the product gases at two levels of pressure subsequent to the combustion reaction. The product gases are analyzed by gas chromatography (G.C.) and infrared spectrophotometry (IR). Gas temperature during combustion is measured by a thermocouple fixed 36±2 mm above the initial sample surface.

For use in this apparatus nominal 20±2 gram samples of each composition are prepared as end burning cylinders having one inch diameter. Each cylinder is wrapped with adhesive backed aluminum tape to inhibit side burning and mounted in a cup supported within the closed bomb chamber. A resistance wire coil is provided on the upper surface of the cylindrical charge to provide ignition. The 24 gauge chromel-alumel thermocouple averages 50 mm from the burning surface over the combustion interval.

Higher pressure gas sample cylinders are evacuated prior to the test, while the remainder of the system is flushed with helium so that initial gas composition within the bomb and low pressure gas sample container prior to ignition is 99% helium. The helium atmosphere is employed since helium is also used as the carrier gas in GC analysis, thus avoiding interference with detection of $N_2$ as a combustion product.

After sample combustion, the product gases are expanded into the higher pressure gas sample containers at pressures less than 100 psig. Further expansion of the remaining gases into the low pressure receiver provides the low pressure gas sample at less than 10 psig. The gas output of the sample is calculated from the expanded gas pressures, the calibrated system volume and the initial sample weight. The measured gas analyses are corrected for the initial helium concentration to obtain comparative gas analyses for the four components for which analyses are developed. Analyses of exhaust gases are made employing a Perkin-Elmer model 521 IR spectrophotometer with a one-meter path length gas cell and a Hewlett Packard Model 810 gas chromatograph. IR analysis is performed with the high pressure gas sample expanded into the gas cell at less than atmospheric pressure.

Quantitative analyses of the gases nitrogen, carbon monoxide, methane and hydrogen cyanide are performed using the gas chromatographic conditions of the table:

| | HCN | $N_2$, CO, $CH_4$ |
|---|---|---|
| Column | 9 ft. × ¼ in. copper tube packed with 25% triacetin on 30-60 mesh Fisher Columpak | 8 ft. × ¼ in. copper tube packed with 30-60 mesh Porapack Q followed by 13.5 ft. × ¼ in. copper tube packed with 30-60 mesh molecular sieve 5A |
| Carrier gas | He | He |
| Gas flow rate | 90 ml/min at 30 psig | 60 ml/min at 30 psig |
| Injection temp (°C.) | 50 | 50 |
| Column temp (°C.) | 75 | 75 |
| Detector temp (°C.) | 210 | 210 |
| Detector | Thermocouple at 200 ma | Thermocouple at 200 ma |

These gases are considered most indicative of useful changes of the generant compositions. Other species such as, ammonia, carbon dioxide, and oxides of nitrogen are encountered in some combustion gas residues but are not quantitated. Trace levels of ammonia from some compositions were noted by IR but could not be detected by the GC techniques employed. The oxides of nitrogen from some compositions were detected by IR. Hydrogen, although predicated by many theoretical calculations could not be detected in the final gas compositions by the GC techniques employed.

Vented Bomb Tests, where specified, are performed in a system which consists of a nozzled chamber for containing the gas generator charge, and an evacuated chamber stimulating the inflatable system. Provision is made within the nozzled chamber for positioning a coolant charge directly above the generant charge. The volume of the nozzled combustion chamber is typically 0.41 liters and it operates normally in the 400 to 500 psi pressure range during burn of the charge. The larger evacuated receiver is 7.8 liters in volume and it normally remains below 45 psi (absolute) during the entire test. The receiver is evacuated before a test and a connecting valve, conveniently a ball valve, between the two vessels is opened just prior to ignition of the charge. Hot gases from combustion rupture a 4 mil polyethylene in-line burst disc placed before the valve to allow gas flow into the receiver. A graphite nozzle is placed at right angles to the gas generator charge to avoid plugging by entrained solid particles. A recessed area around the stainless tube supporting the charge serves to collect the solid combustion residue. The charge is a machined center perforate grain of nominal 25 gram weight having a 0.25 inch center perforation and a 0.33 web which is press fit into a one inch O.D. (outside diameter) by five inch long stainless steel tube (0.049 in.) wall. A coolant charge, if used, is placed in the tube above the generant charge. A nichrome ignition wire is placed in the center perforation. A thermocouple is positioned at a fixed 5 inch distance above the gas generator grain. A second thermocouple is located at the center line of the delivery line to the receiver downstream from the valve. Appropriate pressure transducers are located in the combustion chamber and receiver inlet line.

Chamber and receiver pressures are recorded during a test until the receiver pressure attains equilibrium. Gas output values are calculated from the calibrated system volumes, the charge weight and the measured equilibrium pressure and temperature. The gases collected within the receiver are sealed off using the valve and analyzed as above by infrared and gas chromatography.

EXAMPLE 1

A gas generator composition of the following composition, with quantities in parts by weight (pbw), is prepared and cured.

| | |
|---|---|
| Carboxyl terminated poly(oxydiethylene adipate) M.Wt. 2174, 13.8 pbw, triglycidyl ether of p-aminophenol 1.2 pbw, chromium octoate (diluted 1:1 by weight with 2-ethyl hexanoic acid) 0.05 pbw | Binder 14.9 pbw |
| Carbon black | 0.1 pbw |
| Trimethylolethane trinitrate (TMETN) | 15.0 pbw |
| N,N'—dihydroxyethane diamide (DHG) | 70.0 |

When tested in the closed bomb testing apparatus, the following average values for 6 runs (excluding low HCN values) are found:

| | |
|---|---|
| Burn Rate ($r_b$) (in/sec) | 0.044 |
| Max Temp (°C.) | 830 |
| Gas Output (moles/100g) | 1.85 |
| HCN (mole %) high pressure | 2.6 |
| HCN (mole %) low pressure | 2.6 |
| $N_2$ (mole %) high pressure | 16 |
| $N_2$ (mole %) low pressure | 14 |
| CO (mole %) high pressure | 31 |
| CO (mole %) low pressure | 24 |

-continued

| | |
|---|---|
| $CH_4$ (mole %) high pressure | 5.8 |
| $CH_4$ (mole %) low pressure | 4.7 |

When tested in the vented bomb test, the following results are found:

| | |
|---|---|
| Temp (max, °C.) | 980 |
| Gas output (moles/100g) | 1.96 |
| HCN (mole %) | 4.1 |
| $N_2$ (mole %) | 22 |
| CO (mole %) | 31 |
| $CH_4$ (mole %) | 5 |

EXAMPLE 2

Gas generator compositions analogous to that of Example 1 but substituting the indicated part by weight of metal containing additive as a flame coolant for an equal amount of DHG are prepared. The additives, their quantity and the effect on the indicated parameters are shown below:

| Additive | pbw | $T_{max}$, (°C.) | $r_b$ (in/sec.) | Gas Output (mole/100g) | HCN (mole %) |
|---|---|---|---|---|---|
| $Pb_3O_4$ | 1 | 982 | 0.067 | 1.93 | 4.5 |
| Cu Chromite | 3 | 648 | 0.088 | 1.66 | 0.4 |
| Cu | 5 | 732 | 0.044 | 1.79 | 2.1 |
| $Cu_2O$ | 5 | 732 | 0.078 | 1.78 | 1.8 |
| CuO | 4 | 926 | 0.078 | 1.85 | 2.1 |
| $CuC_2O_4$ | 5 | 677 | 0.061 | 1.33 | 0.25 |
| Cu(DHG) | 5 | 787 | 0.062 | 1.65 | 0.9 |
| FeO | 5 | 538 | 0.055 | 1.88 | 2.6 |
| $Fe_2O_3$ | 5 | 509 | 0.060 | 2.20 | 0.61 |
| $Fe_3O_4$* | 5 | 787 | 0.050 | 1.93 | 3.2 |
| $Fe_3O_4$** | 5 | 427 | 0.069 | 2.11 | 0.40 |
| $Fe_3O_4$*** | 5 | 538 | 0.062 | 2.11 | 0.34 |
| $FeC_2O_4.2H_2O$ | 5 | 677 | 0.085 | 2.04 | 0.32 |

*200μ particle size
**2μ particle size
***<1μ particle size

Data determined by the vented bomb test.

EXAMPLE 3

Gas generants analogous to those of Example 2 employing the 3 most effective flame coolant additives for reducing HCN as replacement for DHG alone and in combination with one another are formulated. The results obtained in vented bomb testing may be summarized by schematic representations as follows:

| Ingredient | Gas Output (moles/100g) |
|---|---|

-continued

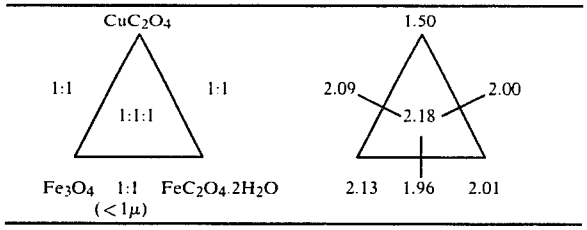

| $T_{max}$ (°C.) | Mole % HCN (<10 psig) |
|---|---|

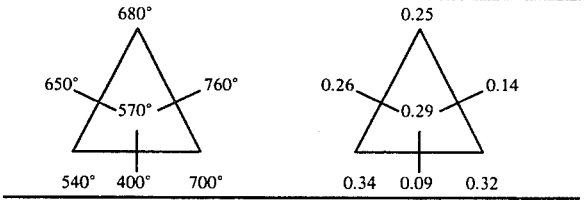

EXAMPLE 4

A gas generant composition analogous to that of Example 2 and corresponding to the additive combination of Example 3 showing lowest HCN content in the product gases is compounded and cured.

| | |
|---|---|
| polyester binder | 14.90 pbw |
| carbon black | 0.10 pbw |
| TMETN | 15.0 pbw |
| DHG | 65.0 pbw |
| $Fe_3O_4$ (<1μ) | 2.5 |
| $FeC_2O_4.2H_2O$ | 2.5 |

The gases produced on firing samples of this composition are passed through coolant beds containing pellets of the indicated ingredient. The temperatures and HCN content of the effluent gases are as indicated.

| Coolant | Gas Temp (°C.) | HCN (Mole %) |
|---|---|---|
| $NaHCO_3$ | 572 | 0.4 |
| Ammonium tartrate | 410 | 0.7 |
| Guanidine carbonate | 404 | 0.7 |

Data determined by the vented bomb test.

We claim:

1. A process for the generation of a gas having a temperature of less than about 575° C. and less than about 0.7 mole % HCN which comprises:

(a) compounding and curing a gas generant composition consisting essentially of a binder component, a polynitrate ester plasticizer component, N,N'-dihydroxyethane diamide, and a HCN scavenger component selected from cupric oxalate, ferrous oxalate, $Fe_3O_4$, or mixtures thereof;

(b) igniting the gas generant composition of step (a) to generate combustion gases; and (c) causing the combustion gases generated in step (b) to pass through a coolant bed of sodium bicarbonate, ammonium tartrate or guanidine carbonate.

* * * * *